US008772223B2

(12) United States Patent
Nagura et al.

(10) Patent No.: US 8,772,223 B2
(45) Date of Patent: Jul. 8, 2014

(54) COMPOSITION FOR SOLID WASHING AGENT, AND SOLID WASHING AGENT

(75) Inventors: Shogo Nagura, Ibaraki (JP); Uhei Tamura, Ibaraki (JP); Tomoko Toda, Sakai (JP); Yoshinobu Saito, Ibaraki (JP); Tetsuo Nishina, Takatsuki (JP)

(73) Assignee: P & PF Co., Ltd., Ibaraki-shi (JP)

( * ) Notice: Subject to any disclaimer, the term of this patent is extended or adjusted under 35 U.S.C. 154(b) by 210 days.

(21) Appl. No.: 13/057,779

(22) PCT Filed: Feb. 26, 2010

(86) PCT No.: PCT/JP2010/053173

§ 371 (c)(1), (2), (4) Date: Feb. 7, 2011

(87) PCT Pub. No.: WO2011/104886

PCT Pub. Date: Sep. 1, 2011

(65) Prior Publication Data

US 2012/0309666 A1 Dec. 6, 2012

(51) Int. Cl.
*C11D 3/37* (2006.01)

(52) U.S. Cl.
USPC ..... 510/466

(58) Field of Classification Search
USPC ..... 510/466
See application file for complete search history.

(56) References Cited

U.S. PATENT DOCUMENTS

| | | | | |
|---|---|---|---|---|
| 5,098,608 | A | 3/1992 | Miyazawa et al. | |
| 2003/0203830 | A1 * | 10/2003 | Zhu et al. | 510/407 |
| 2012/0202895 | A1 * | 8/2012 | Ikeda | 514/772.3 |

FOREIGN PATENT DOCUMENTS

| | | | |
|---|---|---|---|
| JP | 64-060696 | A | 3/1989 |
| JP | 4-001297 | A | 1/1992 |
| JP | 6-264092 | A | 9/1994 |
| JP | 2005-325244 | A | 11/2005 |
| JP | 2006-257016 | A | 9/2006 |

* cited by examiner

*Primary Examiner* — Ling Choi
*Assistant Examiner* — Thuy-Ai Nguyen
(74) *Attorney, Agent, or Firm* — Marvin A. Motsenbocker; Mots Law, PLLC

(57) ABSTRACT

A solid washing agent that is hard even in a high-temperature, high-humidity atmosphere or in a similar environment and that can prevent melting away and stickiness is provided.

A composition for a solid washing agent containing an N-long chain acyl acidic amino acid salt as a component of an ingredient wherein the salt for the N-long chain acyl acidic amino acid salt is composed of an alkali metal salt and an ethanolamine salt, the molar ratio of the alkali metal salt to the ethanolamine salt is 10:90 to 75:25, the degree of neutralization is 1.5 to 2.0 eq, and an alkyl-modified silicone represented by formula (I) below is blended as an ingredient, and a solid washing agent formed from the composition.

9 Claims, No Drawings

COMPOSITION FOR SOLID WASHING AGENT, AND SOLID WASHING AGENT

TECHNICAL FIELD

The present invention relates to an improved acyl acid-based washing agent.

BACKGROUND ART

Solid acylamino acid-based washing agents have disadvantages in that, for example, they are soft and thus melt away promptly, or are sticky. In particular, in the case of transparent washing agents, the gelling of the surface of such washing agents due to melting results in impaired transparency.

Therefore, to address such problems, there have been proposed a washing agent in which an N-long chain acyl amino acid salt has a specific molar ratio of alkali metal salt to ethanolamine salt (see Patent Document 1) and a washing agent in which an N-long chain acyl amino acid salt has a specific molar ratio of potassium salt to sodium salt to ethanolamine salt (Patent Document 2).

CITATION LIST

Patent Document

[Patent Document 1] JP H4-1297A
[Patent Document 2] JP H6-264092A

SUMMARY OF INVENTION

Technical Problem

However, the aforementioned conventional washing agents also have disadvantages in that in a high-temperature, high-humidity atmosphere or in a similar environment they become soft, accelerating melting away and developing stickiness. Especially, recent severe climate change due to global warming makes solid washing agents prepared according to existing standards wanting, and since solid washing agents are always exposed to a high-temperature, high-humidity atmosphere depending on the place or the area of their use, solid washing agents melt away or develop stickiness after becoming soft.

The present invention has been conceived in view of such problems, and it is an object of the present invention to provide a solid washing agent that is hard even in a high-temperature, high-humidity atmosphere or in a similar environment and that can prevent melting away and stickiness.

Solution to Problem

The composition for a solid washing agent of the present invention for solving the aforementioned problems contains an N-long chain acyl acidic amino acid salt as a component of an ingredient. The salt for the N-long chain acyl acidic amino acid salt is composed of an alkali metal salt and an ethanolamine salt. The molar ratio of the alkali metal salt to the ethanolamine salt is 10:90 to 75:25. The degree of neutralization is 1.5 to 2.0 eq. An alkyl-modified silicone represented by formula (I) below is blended as an ingredient.

Chem. 1

(I)

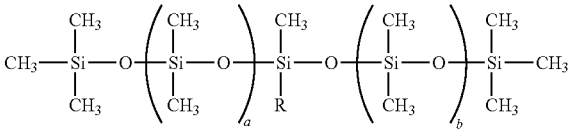

(wherein R represents a linear alkyl or alkenyl group having 8 to 18, and a and b each represents an integer of 0 to 3)

In the composition for a solid washing agent of the present invention described above, N-linear acyl glutamic acid salt, N-linear acyl aspartic acid salt and the like are examples of N-long chain acyl acidic amino acid salts. The amount of the N-long chain acyl acidic amino acid salt blended in the composition for a transparent solid washing agent may be 35 to 80 wt % and preferably 40 to 70 wt % to obtain a washing agent having favorable transparency.

For the N-long chain acyl acidic amino acid salt, those that have an acyl group having 10 to 20 carbon atoms may be used. In particular, it is preferable that an N-long chain acyl acidic amino acid salt having an acyl group having 14 or fewer carbon atoms is blended in a proportion of 45 to 100 wt % of the entire N-long chain acyl acidic amino acid salt. If the proportion is less than 45 wt %, foamability and foam quality may be impaired. Meanwhile, it is preferable that an N-long chain acyl acidic amino acid salt having an acyl group having 18 or more carbon atoms is blended in a proportion of 0 to 36 wt % of the entire N-long chain acyl acidic amino acid salt. If the proportion exceeds 36 wt %, foamability may be impaired.

Moreover, an N-long chain acyl acidic amino acid salt for use may be a mixture of an alkali metal salt and an ethanolamine salt. Examples of alkali metal salts include a potassium salt and a sodium salt. Examples of ethanolamine salts include a monoethanolamine salt, a diethanolamine salt, and a triethanolamine salt. The mixture is required to contain an alkali metal salt and an ethanolamine salt in a molar ratio of 10:90 to 75:25.

A molar ratio for the ethanolamine salt exceeding 90 wt % increases adhesion to the container, possibly resulting in stickiness, and a molar ratio of less than 30 wt % deteriorates stability during high-temperature storage, resulting in impaired transparency.

Moreover, in the composition for a solid washing agent, the degree of neutralization of the N-long chain acyl acidic amino acid salt may be 1.5 to 2.0 eq and preferably 1.7 to 1.9 eq. This is because an excessively low degree of neutralization results in impaired transparency and an excessively high degree of neutralization is likely to deteriorate stability during high-temperature storage.

The alkyl-modified silicone represented by formula (I) may be used in a range of 0.05 to 3 wt % and preferably 0.2 to 2 wt % of the entire composition for a solid washing agent so as to improve resistance to collapsing caused by melting as well as melting caused by rubbing. A proportion of less than 0.05 wt % fails to sufficiently harden the solid washing agent, and a proportion exceeding 3.0 wt % does not create any extra effect in hardening the solid washing agent, thereby wasting the alkyl-modified silicone. A specific alkyl-modified silicone represented by formula (I) is caprylyl methicone.

In addition to the alkyl-modified silicone represented by formula (I) above, an admixture of a cationic polymer and an ampholytic surfactant may be suitably blended to improve resistance to collapsing caused by melting as well as melting caused by rubbing and also to improve foaming properties. This is to take advantage of the synergistic effect of these ingredients, and a cationic polymer and an ampholytic surfactant may be applied in a weight ratio of 95:5 to 5:95.

Here, examples of cationic polymers include poly(diallyldimethylammonium chloride), hydroxyethylcellulose trimethylammonium chloride, hydroxyethylcellulose alkyltrimethylammonium chloride, hydroxypropyl guar gum alkyltrimethylammonium chloride, galactomannan alkyltrimethylammonium chloride, and acrylic acid β-N—N-dimethyl-N-ethylammonioetyl salt vinylpyrrolidone copolymers.

Ampholytic surfactants that are represented by any of the following formulas may be used. That is, they are amidebetaine-based ampholytic surfactants represented by the formula below:

Chem. 2

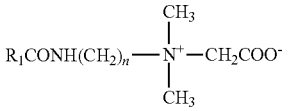

(wherein $R_1$ is an alkyl or alkenyl group having 7 to 21 carbon atoms on average, and n is an integer of 1 to 4), or betaine-based ampholytic surfactants represented by the formula below:

Chem. 3

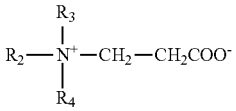

(wherein $R_2$ is an alkyl or alkenyl group having 7 to 21 carbon atoms on average, and $R_3$ and $R_4$ are each an alkyl group having 1 or 2 carbon atoms), or imidazolinium betaine-based ampholytic surfactants represented by the formula below:

Chem. 4

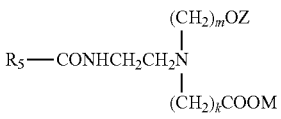

(wherein $R_5$ is an alkyl or alkenyl group having 7 to 21 carbon atoms on average, m and k are each an integer of 1 to 3, Z is a hydrogen atom or a $—(CH_2)_pCOOY$ group (wherein p is an integer of 1 to 3 and Y is an alkali metal, an alkaline earth metal, or an organic amine), and M is an alkali metal, an alkaline earth metal, or an organic amine), or sulfobetaine-based ampholytic surfactants represented by the formula below:

Chem. 5

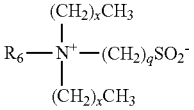

(wherein $R_6$ is an alkyl or alkenyl group having 8 to 22 carbon atoms on average, x is an integer of 0 to 3, and q is an integer of 2 to 4).

The amount of the admixture of a cationic polymer and an ampholytic surfactant blended in the composition for a solid washing agent of the present invention is preferably 0.01 to 10 wt % so as to effectively obtain without any adverse effect the aforementioned effects in improving, for example, resistance to collapsing caused by melting.

Other functional ingredients as mentioned below may be blended in the above-described composition for a solid washing agent according to the present invention as long as various physical properties thereof once processed into a solid washing agent are not adversely affected.

Urea may be suitably used in the aforementioned makeup of the present invention to effectively prevent, without any adverse effect, color deterioration during production and the occurrence of smell change during long-term storage at high temperatures (30° C. or higher). In this case, urea may be blended before preparing the composition for a solid washing agent. There is no limitation to the amount of urea blended in the composition for a solid washing agent and the amount is preferably 0.5 wt % or greater to sufficiently obtain the aforementioned effects and 8.0 wt % or less to prevent generation of amine odor during high-temperature storage.

In the makeup of the present invention described above, a polyhydric alcohol such as glycerol, propylene glycol, sorbitol, ethylene glycol, or diglycerol may be suitably used to effectively obtain a transparent solid washing agent. The amount of the polyhydric alcohol blended is preferably 5 to 30 wt % to maintain the transparency of the solid washing agent. An excessively large amount of polyhydric alcohol liquefies the solid washing agent.

Moreover, a lower alcohol such as ethyl alcohol or propyl alcohol may be also used in a suitable amount. In this case, the amount of the lower alcohol blended is preferably 0.1 to 5 parts by weight per part by weight of the aforementioned polyhydric alcohol so as not to make production troublesome due to thickening. An excessively large amount of the lower alcohol creates disadvantages such as a prolonged drying time during production and results in deteriorated transparency.

Other known ingredients as presented below may be also suitably used. For example, anionic surfactants, cationic surfactants, ampholytic surfactants, nonionic surfactants, germicides, humectants (such as pyrrolidone carboxylic acids, sodium pyrrolidone carboxylates, hyaluronic acid, and polyoxyethylene alkylglucoside ethers), oils, flavoring agents, coloring agents, chelating agents, ultraviolet absorbers, antioxidants, galenicals, and like natural extracts (such as lecithin, saponin, aloe, phellodendron bark, and German chamomile), nonionic, cationic, and anionic water-soluble polymers, skin-feel improvers such as lactic acid esters, and foaming property improvers.

Examples of foaming property improvers include polyoxyethylene alkylsulfuric acid ester salts, N-acylsarcosine salts, N-acyl-N-methyltaurine salts, phosphoric acid ester salts, sulfosuccinic acid salts, α-olefin sulfonic acid salts, higher fatty acid ester sulfonic acid salts, fatty acid soap, and like anionic surface active agents; alkanolamides, polyoxyethylene alkyl ethers, polyoxyethylene hydrogenated castor oil, polyglycerol alkyl ethers, polyglycerol fatty acid esters, and like nonionic surface active agents; etc.

The above-described composition for a solid washing agent can produce a transparent solid washing agent. Unless the solid washing agent has to be transparent, a powdery or granular ingredient may be further blended with the above-described composition.

Examples of powder include spherical silicone powder, spherical silica, poly(methyl methacrylate), talc, sea sponge powder, zinc oxide, kaolinite (clay mineral), bentonite (clay mineral), spherical polyethylene powder, crystalline cellulose, ultrafine titanium oxide particles, and spherical nylon powder.

Granules prepared by combining one or more types of powder as mentioned above and processing the mixture so as to have a desired particle size may be used.

Among such materials, it is particularly preferable to use spherical silicone powder, spherical silica, poly(methyl methacrylate), spherical polyethylene powder, crystalline cellulose, and ultrafine titanium oxide particles. The amount of powder and granule blended in the composition for a solid washing agent, while it may vary depending on the type of powder and granule used, is preferably 20 wt % or less.

The composition for a solid washing agent having the above-described makeup can be processed into a solid washing agent according to a conventional frame kneading method. That is, the above-described composition for a solid washing agent is heated to 70 to 80° C. to uniformly melt it and then introduced into a mold to solidify it while cooling. Thereafter, dry aging is performed to yield a solid washing agent.

The solid washing agent produced in this manner is hard even in a high-temperature, high-humidity atmosphere or in a similar environment, preventing itself from melting away or becoming sticky, and it has excellent foaming properties and foam quality.

Moreover, when no powder or granule is blended, a solid washing agent that has vastly superior transparency can be produced. In addition, since the solid washing agent is hard and does not become soggy even in a high-temperature, high-humidity atmosphere or in a similar environment as described above, it maintains vastly superior transparency even in a high-temperature, high-humidity atmosphere or in a similar environment.

Advantageous Effects of Invention

As stated above, it is possible according to the present invention to maintain the hardness of a solid washing agent even in a high-temperature, high-humidity atmosphere or in a similar environment and to prevent it from melting away or becoming sticky.

DESCRIPTION OF EMBODIMENTS

Hereinafter, embodiments of the present invention will be described.

Examples 1 to 14 and Comparative Examples 1 to 10

Solid washing agents were produced from the compositions for a solid washing agent presented in Tables 1 to 3.

Specifically, a mixture of the aforementioned ingredients was prepared, and the mixture was heated to 70 to 80° C. to uniformly melt the ingredients. The mixture was then poured into a mold. Thereafter, the mixture was solidified by cooling and dry-aged, thereby yielding a solid washing agent. For the Examples and the Comparative Examples, the proportion of sodium salt to potassium salt to triethanolamine salt in the acylamino acid salt and the degree of neutralization are presented in Tables 1 to 3. Regarding Tables 1 to 3, SS-3408 manufactured by Dow Corning Toray Co., Ltd., was used as caprylyl methicone, silicone KF6011 manufactured by Shin-Etsu Chemical Co., Ltd., was used as polyether-modified silicone, Ceolus TG-101 manufactured by Asahi Kasei Corporation was used as crystalline cellulose, titanium dioxide microparticles TTO-55A manufactured by Tayca Corporation was used as titanium oxide, and YSS granules (lot number: 60047, particle size of 35 to 60 mesh) manufactured by P & PF Co., Ltd., were used as granules.

TABLE 1

| Category | | Ex. 1 | Ex. 2 | Ex. 3 | Ex. 4 | Ex. 5 |
|---|---|---|---|---|---|---|
| Amino acid-based surfactant | Cocoyl glutamate | 23.2 | 23.2 | 23.2 | 23.0 | 23.2 |
| | Stearoyl glutamate | 3.3 | 3.3 | 3.3 | 3.3 | 3.3 |
| | Sodium myristoyl glutamate | 6.6 | 6.6 | 6.6 | 6.6 | 6.6 |
| Humectant | Concentrated glycerol | 16.5 | 16.5 | 16.5 | 16.5 | 16.5 |
| Chelating agent | Tetrasodium hydroxyethanediphosphonate | 0.1 | 0.1 | 0.1 | 0.1 | 0.1 |
| Anionic surfactant | Sodium hydroxyalkylethercarbonate | 10.6 | 10.6 | 10.6 | 10.6 | 10.6 |
| Neutralizer | KOH (49%) | 9.14 | 9.14 | 9.14 | 9.14 | 9.14 |
| | TEA (Triethanolamine) | 13.1 | 13.1 | 13.1 | 13.1 | 13.1 |
| Foam quality improver | Cationized cellulose | 0.3 | 0.3 | 0.3 | 0.3 | 0.3 |
| Solvent | Ethyl alcohol | 9.6 | 9.6 | 9.6 | 9.6 | 9.6 |
| | Water | 5.06 | 5.51 | 4.86 | 4.56 | 2.56 |
| Stabilizer | Urea | 2 | 2 | 2 | 2 | 2 |
| Silicone | Caprylyl methicone | 0.5 | 0.05 | 0.7 | 1.0 | 3.0 |
| | Polyether-modified silicone | | | | | |
| Powder and granule | Crystalline cellulose | — | — | — | — | — |
| | Titanium oxide | — | — | — | — | — |
| | Granules | — | — | — | — | — |
| Total | | 100 | 100 | 100 | 100 | 100 |
| Proportion of K:TEA:Na in the formulation | | 43:43:14 | 43:43:14 | 43:43:14 | 43:43:14 | 43:43:14 |
| Content according to acyl group chain length | C14 or fewer (suggested: 45-100%) | 74.8 | 74.8 | 74.8 | 74.8 | 74.8 |
| | C18 or greater (suggested: 36.0 or less) | 15.0 | 15.0 | 15.0 | 15.0 | 15.0 |

TABLE 1-continued

| Category | | Ex. 6 | Ex. 7 | Ex. 8 | Ex. 9 |
|---|---|---|---|---|---|
| Amino acid-based surfactant | Cocoyl glutamate | 23.2 | 23.2 | 23.2 | 23.2 |
| | Stearoyl glutamate | 3.3 | 3.3 | 3.3 | 3.3 |
| | Sodium myristoyl glutamate | 6.6 | 6.6 | 6.6 | 6.6 |
| Humectant | Concentrated glycerol | 9.5 | 16.3 | 16 | 8.8 |
| Chelating agent | Tetrasodium hydroxyethanediphosphonate | 0.1 | 0.1 | 0.1 | 0.1 |
| Anionic surfactant | Sodium hydroxyalkylethercarbonate | 10.6 | 10.6 | 10.6 | 10.6 |
| Neutralizer | KOH (49%) | 9.14 | 9.14 | 9.14 | 9.14 |
| | TEA (Triethanolamine) | 13.1 | 13.1 | 13.1 | 13.1 |
| Foam quality improver | Cationized cellulose | 0.3 | 0.3 | 0.3 | 0.3 |
| Solvent | Ethyl alcohol | 9.6 | 9.6 | 9.6 | 9.6 |
| | Water | 5.06 | 5.06 | 5.06 | 6.06 |
| Stabilizer | Urea | 2 | 2 | 2 | 2 |
| Silicone | Caprylyl methicone | 0.5 | 0.5 | 0.5 | 0.5 |
| | Polyether-modified silicone | | | | |
| Powder and granule | Crystalline cellulose | 7.0 | — | — | 7.0 |
| | Titanium oxide | — | 0.2 | — | 0.2 |
| | Granules | — | — | 0.5 | 0.5 |
| Total | | 100 | 100 | 100 | 100 |
| Proportion of K:TEA:Na in the formulation | | 43:43:14 | 43:43:14 | 43:43:14 | 43:43:14 |
| Content according to acyl group chain length | C14 or fewer (suggested: 45-100%) | 74.8 | 74.8 | 74.8 | 74.8 |
| | C18 or greater (suggested: 36.0 or less) | 15.0 | 15.0 | 15.0 | 15.0 |

TABLE 2

| Category | | Ex. 10 | Ex. 11 | Ex. 12 | Ex. 13 | Ex. 14 |
|---|---|---|---|---|---|---|
| Amino acid-based surfactant | Cocoyl glutamate | 0 | 0 | 24.8 | 22.9 | 19.4 |
| | Stearoyl glutamate | 0 | 20.15 | 3.6 | 3.3 | 8.3 |
| | Sodium myristoyl glutamate | 40.73 | 16.48 | 7.1 | 6.5 | 0 |
| Humectant | Concentrated glycerol | 15 | 15 | 16.5 | 16.5 | 16.5 |
| Chelating agent | Tetrasodium hydroxyethanediphosphonate | 0.1 | 0.1 | 0.1 | 0.1 | 0.1 |
| Anionic surfactant | Sodium hydroxyalkylethercarbonate | 10.6 | 10.6 | 10.6 | 10.6 | 10.6 |
| Neutralizer | KOH (49%) | 4.48 | 7.01 | 7.71 | 9.46 | 1.69 |
| | TEA (Triethanolamine) | 6.43 | 10.06 | 11.07 | 13.59 | 21.87 |
| Foam quality improver | Cationized cellulose | 0.3 | 0.3 | 0.3 | 0.3 | 0.3 |
| Solvent | Ethyl alcohol | 12 | 12 | 9.6 | 9.6 | 9.6 |
| | Water | 7.86 | 5.8 | 6.12 | 4.65 | 9.14 |
| Stabilizer | Urea | 2 | 2 | 2 | 2 | 2 |
| Silicone | Caprylyl methicone | 0.5 | 0.5 | 0.5 | 0.5 | 0.5 |
| | Polyether-modified Silicone | | | | | |
| Powder and granule | Crystalline cellulose | — | — | — | — | — |
| | Titanium oxide | — | — | — | — | — |
| | Granules | — | — | — | — | — |
| Total | | 100 | 100 | 100 | 100 | 100 |
| Proportion of K:TEA:Na in the formulation | | 25:25:50 | 38.8:38.8:22.4 | 43:43:14 | 43:43:14 | 10:90:0 |
| Content according to acyl group chain length | C14 or fewer (suggested: 45-100%) | 100 | 45 | 74.8 | 74.8 | 54.8 |
| | C18 or greater (suggested: 36.0 or less) | 0 | 35.8 | 15.0 | 15.0 | 28.0 |

TABLE 3

| Category | | Comp. Ex. 1 | Comp. Ex. 2 | Comp. Ex. 3 | Comp. Ex. 4 | Comp. Ex. 5 | Comp. Ex. 6 |
|---|---|---|---|---|---|---|---|
| Amino acid-based surfactant | Cocoyl glutamate | 23.2 | 23.2 | 23.2 | 33.1 | 33.1 | — |
| | Stearoyl glutamate | 3.3 | 3.3 | 3.3 | — | — | 33.1 |
| | Sodium myristoyl glutamate | 6.6 | 6.6 | 6.6 | — | — | — |
| Humectant | Concentrated glycerol | 16.5 | 16.5 | 16.5 | 16.5 | 16.5 | 16.5 |
| Chelating agent | Tetrasodium hydroxyethanediphosphonate | 0.1 | 0.1 | 0.1 | 0.1 | 0.1 | 0.1 |
| Anionic surfactant | Sodium hydroxyalkylethercarbonate | 10.6 | 10.6 | 10.6 | 10.6 | 10.6 | 10.6 |
| Neutralizer | KOH (49%) | 9.14 | 9.14 | 9.14 | 9.14 | 9.14 | 9.14 |
| | TEA (Triethanolamine) | 13.1 | 13.1 | 13.1 | 13.1 | 13.1 | 13.1 |
| Foam quality improver | Cationized cellulose | 0.3 | 0.3 | 0.3 | 0.3 | 0.3 | 0.3 |
| Solvent | Ethyl alcohol | 9.6 | 9.6 | 9.6 | 9.6 | 9.6 | 9.6 |
| | Water | 5.56 | 5.56 | 5.56 | 5.06 | 5.56 | 5.06 |
| Stabilizer | Urea | 2 | 2 | 2 | 2 | 2 | 2 |
| Silicone | Caprylyl methicone | — | — | — | 0.5 | — | 0.5 |
| | Polyether-modified Silicone | 1.0 | 2.0 | 3.0 | | | |

TABLE 3-continued

| | | | | | | | |
|---|---|---|---|---|---|---|---|
| Powder and granule | Crystalline cellulose | — | — | — | — | — | — |
| | Titanium oxide | — | — | — | — | — | — |
| | Granules | — | — | — | — | — | — |
| Total | | 101 | 102 | 103 | 100 | 100 | 100 |
| Proportion of K:TEA:Na in the formulation | | 43:43:14 | 43:43:14 | 43:43:14 | 50:50:00 | 50:50:00 | 50:50:00 |
| Content according to acyl group chain length | C14 or fewer (suggested: 45-100%) | 74.8 | 74.8 | 74.8 | 78.3 | 78.3 | 0 |
| | C18 or greater (suggested: 36.0 or less) | 15.0 | 15.0 | 15.0 | 12.1 | 12.1 | 65 |

| Category | | Comp. Ex. 7 | Comp. Ex. 8 | Comp. Ex. 9 | Comp. Ex. 10 |
|---|---|---|---|---|---|
| Amino acid-based surfactant | Cocoyl glutamate | — | — | 0 | 4.95 |
| | Stearoyl glutamate | 33.1 | — | 23.4 | 18.16 |
| | Sodium myristoyl glutamate | — | 33.1 | 10.03 | 9.91 |
| Humectant | Concentrated glycerol | 16.5 | 16.5 | 15 | 15 |
| Chelating agent | Tetrasodium hydroxyethanediphosphonate | 0.1 | 0.1 | 0.1 | 0.1 |
| Anionic surfactant | Sodium hydroxyalkylethercarbonate | 10.6 | 10.6 | 10.6 | 10.6 |
| Neutralizer | KOH (49%) | 9.14 | 9.14 | 7.14 | 7.39 |
| | TEA (Triethanolamine) | 13.1 | 13.1 | 10.24 | 10.6 |
| Foam quality improver | Cationized cellulose | 0.3 | 0.3 | 0.3 | 0.3 |
| Solvent | Ethyl alcohol | 9.6 | 9.6 | 12 | 12 |
| | Water | 5.56 | 5.06 | 8.69 | 8.49 |
| Stabilizer | Urea | 2 | 2 | 2 | 2 |
| Silicone | Caprylyl methicone | — | 0.5 | 0.5 | 0.5 |
| | Polyether-modified Silicone | | | | |
| Powder and granule | Crystalline cellulose | — | — | — | — |
| | Titanium oxide | — | — | — | — |
| | Granules | — | — | — | — |
| Total | | 100 | 100 | 100 | 100 |
| Proportion of K:TEA:Na in the formulation | | 50:50:00 | 25:25:50 | 42.5:42.5:15 | 42.5:42.6:15 |
| Content according to acyl group chain length | C14 or fewer (suggested: 45-100%) | 0 | 100 | 30 | 41.7 |
| | C18 or greater (suggested: 36.0 or less) | 65 | 0 | 45.5 | 37.6 |

Various physical properties of the solid washing agents obtained in this manner were examined as follows.

Solidifying Point

A solution of a composition for a solid washing agent that had been thermally melted was introduced into a cup and stirred while monitoring the temperature with a thermometer, and the temperature was measured when the temperature remained constant after the solution started solidifying.

Stickiness (in Numerical Value)

The surface of a solid washing agent was shaved so as to make it flat. The stress created when a needle-shaped adapter was inserted into and removed from three different places was measured and averaged. The difference (ratio) between the values obtained in inserting and removing the adapter was used to numerically evaluate stickiness. A thin needle-shaped adapter having a diameter of 2 mm was attached to a rheometer (manufactured by Fudoh Kogyo Co. Ltd.), and the adapter was inserted to a depth of penetration of 10 mm at a rate of 6 cm/min with a load of 2 kg and removed at the same rate. The measurement was performed at room temperature.

Stickiness (Sensory)

The solid washing agents were cut to have the same size and evaluated by how it feels on the fingers in comparison with slightly acidic soap (trade name "Transparent Delica Mizzle Cake (D)" manufactured by P & PF Co., Ltd.) as a standard.

The evaluation criterion was as follows: when less sticky than the standard, given "A"; when slightly less sticky than the standard, given "B"; when as sticky as the standard, given "C"; when stickier than the standard, given "D"; and when much stickier than the standard, given "E". The final evaluation was made by averaging the evaluations submitted by five panelists. "A" to "C" were regarded as acceptable.

Extent of Melting Caused by Rubbing

The extent of melting caused by rubbing was measured according to JIS K-3304. That is, a specimen (cross section of 15 mm×20 mm) weighing a specific amount was placed on a film wetted with tap water adjusted to 40° C., and the film was rotated so as to melt the specimen by rubbing for 10 minutes. Using the weight before and after melting caused by rubbing, the extent of melting within a given area was calculated according to the following formula:

$$\text{Extent of melting caused by rubbing}(\%)=(\text{weight after}-\text{weight before})\times 100/3$$

Hardness (in Numerical Value)

The stress created when the adapter was inserted was measured during the above-described stickiness test (carried out to collect numerical values).

Hardness (Sensory)

The solid washing agents were cut to have the same size and evaluated by how it feels on the fingers in comparison with slightly acidic soap (trade name "Transparent Delica Mizzle Cake (D)" manufactured by P & PF Co., Ltd.) as a standard.

The evaluation criterion was as follows: when harder than the standard, given "A"; when slightly harder than the standard, given "B"; when as hard as the standard, given "C"; when softer than the standard, given "D"; and when much softer than the standard, given "E". The final evaluation was made by averaging the evaluations submitted by five panelists. "A" to "C" were regarded as acceptable.

Foaming Ability 400 ml of an aqueous solution was provided in which a solid washing agent was dissolved to a concentration of 1 wt % in artificial hard water prepared by dissolving calcium chloride in ion-exchanged water (70 ppm). The aqueous solution was stirred with a mixer bubble generator in an environment of a solution temperature of 40° C. and an atmospheric temperature of 25° C., and the volume of foam at specific points in time was measured.

The volume of foam 20 seconds after the beginning of stirring was measured to evaluate quick-foaming properties.

The volume of foam 60 seconds after the beginning of stirring was measured to evaluate foaming properties.

After stirring for 60 seconds, a time until the amount of water separated in the bottom reached 200 ml was measured to evaluate foam stability.

An aqueous solution prepared separately from the aqueous solution stirred with the mixer bubble generator was applied to a hand and foamed, and the foaming properties were evaluated by how it feels on the hand in comparison with slightly acidic soap (trade name "Transparent Delica Mizzle Cake (D)" manufactured by P & PF Co., Ltd.) as a standard.

The evaluation criterion was as follows: when greater foaming ability than the standard, given "A"; when slightly greater foaming ability than the standard, given "B"; when the same forming ability as the standard, given "C"; when weaker foaming ability than the standard, given "D"; and when much weaker foaming ability than the standard, given "E". The final evaluation was made by averaging the evaluations submitted by five panelists. "A" to "C" were regarded as acceptable.

Results are presented in Tables 4 to 6.

TABLE 4

| | | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|---|
| Evaluation item | Solidifying point (° C.) | 65.3 | 62.3 | 67.1 | 67.5 | 72.0 | 66.0 | 65.2 | 64.5 | 66.0 |
| | Insertion/removal (after 10 days of aging) | 1.11 | 1.04 | 1.10 | 1.16 | 1.12 | 0.83 | 1.06 | 1.07 | 1.03 |
| | Extent of melting caused by rubbing | 63.3 | 63.2 | 62.7 | 62.7 | 61.7 | 50.0 | 61.4 | 57.7 | 50.3 |
| | Stickiness (sensory) | B | B | A | A | A | A | A | A | A |
| | Hardness (sensory) | B | B | A | A | A | A | A | A | A |
| | Hardness (in numerical value) | 407 | 410 | 413 | 470 | 487 | 450 | 450 | 437 | 397 |
| | Soap content | 48 | 48 | 48 | 48 | 48 | 48 | 48 | 48 | 48 |
| | Degree of neutralization | 1.9 | 1.9 | 1.9 | 1.9 | 1.9 | 1.9 | 1.9 | 1.9 | 1.9 |
| Foaming ability | Quick-foaming properties (ml) | 2150 | 2100 | 2100 | 2000 | 1900 | 1900 | 2100 | 2000 | 2100 |
| | Foaming properties (ml) | 2200 | 2200 | 2100 | 2000 | 1950 | 2050 | 2100 | 2000 | 2100 |
| | Water separation time | 17'50" | 14'13" | 12'21" | 11'24" | 10'16" | 12'25" | 12'04" | 12'21" | 13'22" |
| Evaluation of overall foaming ability (sensory) | | A | A | A | A | A | A | A | A | A |

TABLE 5

| | | Ex. 10 | Ex. 11 | Ex. 12 | Ex. 13 | Ex. 14 |
|---|---|---|---|---|---|---|
| Evaluation item | Solidifying point (° C.) | 61.8 | 56.7 | 57.0 | 66.5 | 60.2 |
| | Insertion/removal (after 10 days of aging) | 1.12 | 1.12 | 1.14 | 1.03 | 1.15 |
| | Extent of melting caused by rubbing | 57.2 | 56.9 | 60.8 | 56.5 | 58.3 |
| | Stickiness (sensory) | C | C | C | B | C |
| | Hardness (sensory) | C | C | C | B | C |
| | Hardness (in numerical value) | 326 | 346 | 305 | 410 | 300 |
| | Soap content | 48 | 48 | 48 | 48 | 48 |
| | Degree of neutralization | 1.9 | 1.9 | 1.5 | 2 | 2 |
| Foaming ability | Quick-foaming properties (ml) | 1800 | 1800 | 2000 | 2150 | 2000 |
| | Foaming properties (ml) | 2000 | 2000 | 2100 | 2200 | 2150 |
| | Water separation time | 11'23" | 10'20" | 16'25" | 17'50" | 17'02" |
| Evaluation of overall foaming ability (sensory) | | A | A | A | A | A |

TABLE 6

| | | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 9 | Comp. Ex. 10 |
|---|---|---|---|---|---|---|---|---|---|---|---|
| Evaluation item | Solidifying point (° C.) | 51.8 | 47.5 | 43.8 | 57.0 | 50.2 | 62.5 | 56.4 | — | 52.4 | 47 |
| | Insertion/removal (after 10 days of aging) | 1.09 | 1.29 | 1.67 | 1.10 | 1.25 | 1.14 | 1.28 | — | 1.3 | 1.33 |
| | Extent of melting caused by rubbing | 71.2 | 72.2 | 74.4 | 78.7 | 90.0 | 60.9 | 63.0 | — | 61.2 | 60.6 |
| | Stickiness (sensory) | D | D | E | D | E | C | D | — | D | D |
| | Hardness (sensory) | D | D | E | D | E | C | D | — | D | D |
| | Hardness (in numerical value) | 220 | 183 | 150 | 147 | 140 | 287 | 153 | — | 121 | 205 |
| | Soap content | 48 | 48 | 48 | 48 | 48 | 48 | 48 | 48 | 48 | 48 |
| | Degree of neutralization | 1.9 | 1.9 | 1.9 | 1.4 | 1.4 | 2 | 2 | 4.8 | 1.9 | 1.9 |

TABLE 6-continued

| | | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 9 | Comp. Ex. 10 |
|---|---|---|---|---|---|---|---|---|---|---|---|
| Foaming ability | Quick-foaming properties (ml) | 1400 | 1300 | 1250 | 1400 | 1450 | 1300 | 1350 | 1600 | 1250 | 1200 |
| | Foaming properties (ml) | 1550 | 1400 | 1300 | 1450 | 1500 | 1350 | 1400 | 1800 | 1300 | 1350 |
| | Water separation time | 3'35" | 3'30" | | 9'57" | 8'34" | 10'25" | 10'02" | 11'46" | 3'30" | 2'25" |
| Evaluation of overall foaming ability (sensory) | | D | D | E | D | D | D | D | C | E | D |

The results presented in Tables 4 to 6 confirm that the solid washing agents according to the present invention can maintain sufficient hardness and prevent stickiness and melting away and also can exhibit a foaming ability that is identical to or greater than that of conventional products.

The present invention may be embodied in various other forms without departing from the spirit or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

INDUSTRIAL APPLICABILITY

The solid washing agent according to the present invention is suitably used in a high-temperature, high-humidity atmosphere or in a similar environment.

The invention claimed is:

1. A composition for a solid washing agent that is highly foaming yet hard even in a high-temperature, high humidity environment, comprising:

an N-long chain acyl acidic amino acid salt as a component of an ingredient, a salt for the N-long chain acyl acidic amino acid salt comprising an alkali metal salt and an ethanolamine salt, a molar ratio of the alkali metal salt to the ethanolamine salt being 10:90 to 75:25, a degree of neutralization being 1.5 to 2.0 eq, and an alkyl-modified silicone represented by formula (I) below as an ingredient:

[Chem 1]

(I)

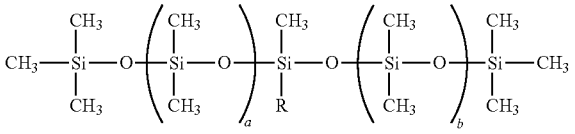

wherein R represents an alkyl or alkenyl group having 8 to 18, and a and b each represent an integer of 0 to 3;

wherein the composition has a maximum extent of melting caused by rubbing of 70 g/100 $cm^2$ as determined according to JIS K-3304 and has foaming properties of at least 1950 ml as determined by stirring 400 ml of 1 wt % in aqueous 70 ppm calcium chloride at 40 degrees Centigrade for 60 seconds.

2. The composition for a solid washing agent according to claim 1, wherein the alkyl-modified silicone represented by formula (I) above is caprylyl methicone.

3. The composition for a solid washing agent according to claim 1, wherein the N-long chain acyl acidic amino acid salt has an acyl group having 10 to 20 carbon atoms.

4. A solid washing agent formed from the composition for a solid washing agent of claim 1.

5. A composition for a solid washing agent, comprising:

an N-long chain acyl acidic amino acid salt as a component of an ingredient, a salt for the N-long chain acyl acidic amino acid salt comprising an alkali metal salt and an ethanolamine salt, a molar ratio of the alkali metal salt to the ethanolamine salt being 10:90 to 75:25, a degree of neutralization being 1.5 to 2.0 eq, and caprylyl methicone as an ingredient, wherein of the N-long chain acyl acidic amino acid salt, an N-long chain acyl acidic amino acid salt having an acyl group having 14 or fewer carbon atoms accounts for 45 to 100 wt % and an N-long chain acyl acidic amino acid salt having an acyl group having 18 or more carbon atoms accounts for 0 to 36 wt %.

6. The composition for a solid washing agent according to claim 5, wherein the N-long chain acyl acidic amino acid salt has an acyl group having 10 to 20 carbon atoms.

7. A solid washing agent formed from the composition for a solid washing agent of claim 5.

8. The composition for a solid washing agent according to claim 5, wherein the composition has a melting temperature of at least 60 degrees centigrade.

9. The composition for a solid washing agent according to claim 5, characterized by having a maximum extent of melting caused by rubbing of 70 g/100 $cm^2$.

* * * * *